US005513886A

United States Patent [19]

Cyr

[11] Patent Number: 5,513,886

[45] Date of Patent: May 7, 1996

[54] UNDERSEA RELEASE APPARATUS

[75] Inventor: Scott M. Cyr, Goleta, Calif.

[73] Assignee: Sonatech, Inc., Santa Barbara, Calif.

[21] Appl. No.: 148,897

[22] Filed: Nov. 8, 1993

[51] Int. Cl.[6] ..... B66C 1/34

[52] U.S. Cl. ..... 294/66.1; 294/82.3; 294/82.33

[58] Field of Search ..... 405/190, 191, 405/171, 224; 441/1, 2, 11, 6, 23, 24, 33; 294/66.1, 66.2, 82.1, 82.15, 82.33, 83.34, 82.3

[56] References Cited

U.S. PATENT DOCUMENTS

| | | | |
|---|---|---|---|
| 1,873,617 | 8/1932 | Mehl | 405/190 |
| 3,121,239 | 2/1964 | Cannon, Jr. | 441/24 |
| 3,337,255 | 8/1967 | Nicoloff | 294/66.1 |
| 3,504,407 | 4/1970 | Dawson | 294/82.33 |
| 3,602,959 | 9/1971 | Perez | 441/2 |
| 3,831,387 | 8/1974 | Rolleman | 405/191 |
| 3,848,226 | 11/1974 | Perez | 441/11 |
| 5,022,013 | 6/1991 | Dalton et al. | 441/33 |

*Primary Examiner*—Ramon S. Britts
*Assistant Examiner*—Frederick L. Lagman
*Attorney, Agent, or Firm*—Ladas & Parry

[57] ABSTRACT

An undersea release apparatus for positively releasing a connecting link from an underwater device, the apparatus comprising a latching mechanism on the device for latching the connecting link to the device in a latched condition, and for unlatching the connecting link to be free of the device in an unlatched condition. A driving mechanism positively moves the latching mechanism to its unlatched condition. The driving mechanism drives a rotatable cam which retains a pelican hook at a fixed latched position, and positively drives the pelican hook from the latched position to an unlatched position. The apparatus is also provided with an arming function, whereby the rotatable cam is rotated in a direction opposite to that which is effective to unlatch the connecting link, whereby the pelican hook is pivoted back to its first or latched position in which the pelican hook relatches with the connecting link.

21 Claims, 5 Drawing Sheets

UNDERSEA RELEASE APPARATUS

BACKGROUND OF THE INVENTION

1. Field of the Invention

This invention relates to an undersea release apparatus for releasing underwater devices, and more particularly to an improved release mechanism which operates reliably in the face of the adverse environmental conditions encountered at both shallow and full ocean depths, including extreme hydrostatic pressures.

2. Brief Description of the Prior Art

Recovering previously deposited underwater devices from the ocean floor requires the use of a release mechanism attached to an anchor by means of a connecting link fixedly attached to the anchor and releasably attached to the bottom of the underwater device. The release may be effected by an external latch on the outside of the underwater device and driven to an unlatched position by electromechanical components within the underwater device. For example, in an undersea acoustic transponder device, a signal can be transmitted by the recovery ship, and apparatus within the transponder, upon receiving the appropriate transmitted command code, moves the external latch to its unlatched position so as to permit the link to be released from the anchor, allowing a floatation assembly, connected to the top of the underwater device, to transport the underwater device to the surface. In the past, however, the mechanisms designed for unlatching the link from the anchor have been ineffective for a variety of reasons.

First, full ocean depth mechanical or electro-mechanical release mechanisms may be subject to extreme deep ocean hydrostatic pressures, resulting in correspondingly high frictional drag on any moving part of the latch mechanically actuated from within the underwater device. A rotating shaft penetrating the top plate of an undersea device, for example, exhibits very large frictional drag against bushings separating the cap of the shaft from the top plate, even when using bushings having a low friction coefficient. Secondly, sand, debris, as well as biological growth can prevent release of the link from the release mechanism, especially if the underwater device has been deployed for a number of weeks or months.

One prior art solution to the unreliable release problem is the provision of an elongated pivotal pelican hook which has its upper end latched by the latch mechanism and its lower end capturing the link between the curved end of the hook and a slotted frame member of the underwater device. Upon release of the top of the pelican hook, a downwardly directed force on the connecting link by the weight of the anchor (due to the buoyancy of the floatation assembly pulling the underwater device upwardly) applies pressure to the bight portion of the hook which pressure is intended to be sufficient to pivot the pelican hook about its axis and free the link by moving the hook portion out of the slot of the frame. Again, however, because of the frictional drag between the bight portion of the pelican hook and the bottom side of the link, the friction at the hook/frame pivot points, and debris which may have accumulated at the pivot points or at the release point at the bottom of the pelican hook, there may be insufficient force against the hook by the link to pivot the hook out of its blocking position with respect to the frame, and the underwater device cannot be released and recovered. In such an adverse environment, even reliably operating an unlatching mechanism to release the top of the pelican hook is a problem, aside from the separate problem of pivoting the pelican hook after its release. The release problems with such an arrangement of the prior art become even more acute when the considering that, in some instances, the positive buoyancy of the floatation assembly may be, deliberately, small, and therefore the force exerted by the floatation assembly is often insufficient to effect reliable release of the device. One solution to this problem is to increase the offset between the hook/link contact point and the hook pivot axis to give greater leverage in pivoting the hook. However, this requires greater latching forces which must be overcome by the release mechanism, compounding the release problems.

Another prior art undersea release apparatus uses a hollow rotatable cylindrical element which has sloping curved cutouts on its opposing walls for positively driving a pivot pin a small distance. This movement is intended to release the capture of the end of a pivoting arm so that the arm can pivot and thereby release the connecting link between the anchor and the underwater device. However, as with the other prior art device described above, simply unlatching a pivoting arm does not necessarily guarantee that the arm will pivot, again due to the influencing factors of high hydrostatic pressure and fouling by debris and growth.

Other prior art release apparatuses are known which vary only in the manner in which the element capturing the connecting link is released. In all such prior art apparatuses, when the adverse conditions are severe enough or are combined, all such prior art apparatuses will fail for the reasons described above with respect to the specific examples of prior art arrangements.

There is therefore a recognized need in the art to provide an undersea release apparatus which reliably releases the connecting link from a deployed underwater device in the face of extreme adverse environmental conditions. The present invention provides such an apparatus.

SUMMARY OF THE INVENTION

The present invention overcomes the above-mentioned faults and deficiencies of the prior art by providing an undersea release apparatus for positively releasing a connecting link from an underwater device, the apparatus comprising a latching mechanism on the device for latching the connecting link to the device in a latched condition, and for unlatching the connecting link to be free of the device in an unlatched condition. A driven unlatching mechanism positively moves the latching mechanism to its unlatched condition. Thus, as compared with the prior art which merely frees a latching mechanism so that it can move by the application of a pulling force on the connecting link to effect release, the present invention utilizes a driven unlatching mechanism for positively moving the latching mechanism to an unlatched condition.

A drive means is provided for positively driving the latching mechanism to its unlatched condition. As a result, after completing the unlatching function, all that is required of the floatation assembly is to provide sufficient, minimal, pulling force to free the anchored connecting link from the latching means. This would typically involve simply sliding the connecting link along a relatively unbarricaded slot in the frame of the latching mechanism. As a result, the frictional drag, even at extreme ocean depths, will be minimal or even nonexistent, since the connecting link need only clear a short path along the length of the containing slot. With the blockage of the slot removed by the positive releasing action of the latching mechanism (withdrawal of the hook from the slot) according to the present invention, it would be practically impossible for enough debris or growth to accumulate along the short path the connecting link would have to pass, to prevent release of the connecting link. Accordingly, this is not a factor in the operation of the present invention, and thus a 100% reliability of release can be expected, barring unrelated factors such as an insufficient power source (low batteries), command-receiving electronics failure, and the like.

In a preferred embodiment, the invention employs a motor driven release mechanism primarily designed for use on undersea acoustic transponders deployed in adverse conditions where contamination, biological growth, or growth products impede the release and recovery of the underwater devices. The invention is designed for accommodating static release loads up to 10,000 lbs. and dynamic release loads up to 20,000 lbs., and for use in depths up to 20,000 feet.

A preferred embodiment of the undersea release apparatus according to the present invention features a pelican hook system actuated by a face cam designed to function in passive and active stages. In the passive stage, the pelican hook is fixed in a latched position, and in the active stage, the pelican hook is positively driven by the cam face to an unlatched or released position. The cam is actuated by a DC geared motor through a motor control board in the electronics of the device. A release command is recognized by the device which, in turn, actuates the motor and rotates the cam. As the cam rotates, a butt portion of the cam is moved to allow the pelican hook to swing open independently. If the hook is jammed, fouled, or does not open independently, the active stage of the cam takes over and forces the pelican hook open, thereby permitting the connecting link to exit its containing guide slot relatively unimpeded. The guide slot presents an increasing link-to-slot separation during the release mode. This reduces the possibility of a link jam caused by fouling products.

The deep water, high load features of the present invention are achieved by reducing friction caused by hydrostatic pressure and/or high release loads. The frictional load produced by the unbalanced hydrostatic pressure acting on the cam's upper surface (determined in magnitude by the diameter of the cam shaft and the internal and external pressures) is reduced by carrying the end load of the shaft on an internal thrust bearing. The use of an internal thrust bearing design, unique to the present invention, versus an external bearing, results in a significant reduction in friction coefficient. While a typical external bearing friction coefficient is 0.08, the internal thrust bearing friction coefficient can be as low as 0.001, for example. Thus, a smaller motor with reduced current requirement can accomplish higher release loads at full ocean depths than was previously possible.

The apparatus according to the invention is also provided with an arming function, whereby the rotatable cam is rotatable in a direction opposite to that which is effective to unlatch the connecting link, whereby the pelican hook may be pivoted back to its first or latched position in which the pelican hook relatches with the connecting link.

Release mechanisms available to date fail to arm properly if foreign objects are encountered or if an improper connecting link is used. Further, if armed improperly, they may fail to release when ordered to do so.

The present invention differs from the prior art in that the motor control circuitry features "arm" and "release fail safe" modes and will sense that an improper link is being used and will automatically reverse the rotation of the cam causing the release mechanism to physically eject the foreign object or improper connecting link. Clearing of the objects and an "arm" command is necessary to successfully arm the system. Should a jam occur during the release mode, the motor control board will sense the failure and cycle and recycle the rotation of the cam until released or for a duration of 30 seconds. This cyclical action causes release inhibitors to break apart incrementally, allowing momentum to build on each cycle until full release occurs.

BRIEF DESCRIPTION OF THE DRAWING

The above-mentioned features of the invention, as well as other features not yet mentioned, will now be described in detail with reference to the accompanying drawings. It is to be noted that in the discussion above, the orientation of the underwater device has been assumed to be normal, i.e. with the release mechanism located at the bottom of the underwater device and linked to an anchor on the ocean floor. In the drawing, and in the description which follows, as a matter of convenience only, the orientation of the underwater device is invented. In the drawing:

FIG. 12 shows the fully released position of the movable releasing member;

DETAILED DESCRIPTION OF THE PREFERRED EMBODIMENT

The invention will now be described for use with an undersea acoustic transponder such as that shown in perspective in FIG. 1 (only the lower end of the transponder, without a casing, is shown). It will be understood, however, that any type of underwater device which is intended to be deployed and then recovered by action of a release mechanism can beneficially utilize the invention for improved and extremely reliable release effectiveness. The preferred embodiment of the invention as shown on the transponder of FIG. 1 may also be configured in a variety of different mechanical designs, and it will be understood that the specific design described below is merely representative of a number of different designs that could be employed.

As previously mentioned, the drawings show the device and its components in an invented orientation for convenience. Accordingly, terms such as "upper", "lower", "top", "bottom", and the like are opposite to the actual orientation of the device in use.

Figure 1:
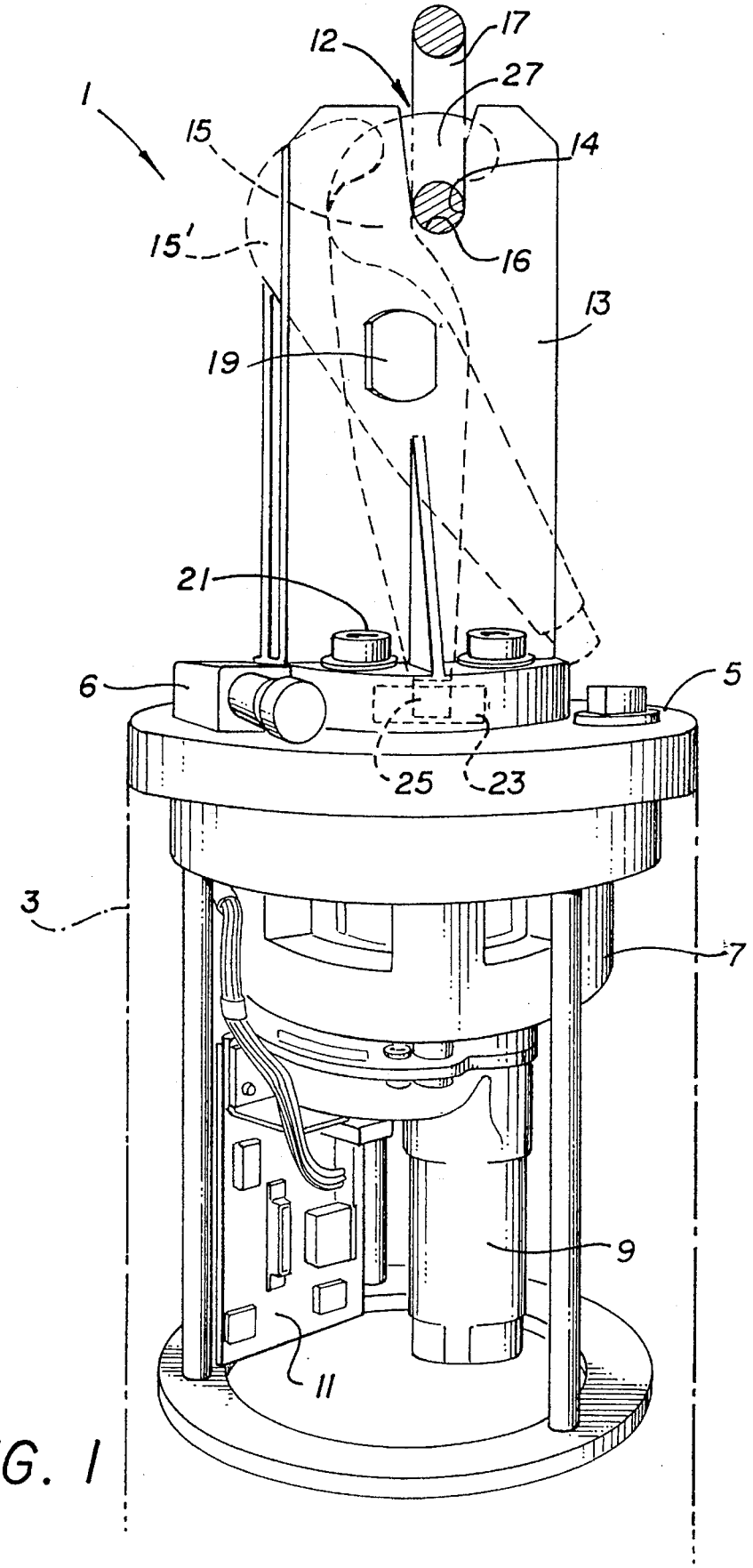
FIG. 1 is a perspective view of one embodiment of the present invention in which a pelican hook arrangement is shown at the end of an undersea acoustic transponder.

The underwater device 1 (transponder) may be mounted at the end of a tubular casing 3, shown in phantom in FIG. 1, which casing 3 not only houses the transponder components and the driven release mechanism of the present invention, but also will house a battery power source and other desirable components. Other than housing the required electromechanical parts necessary for operation of the present invention, any other components placed within tubular casing 3 is left at the discretion of the user.

Tubular casing 3 is water-sealed at its upper end with a thick non-corrosive top plate 5 upon which is mounted an acoustic sensor 6 for the transponder electronics within casing 3 (not shown), and a frame structure 13 rigidly attached to top plate 5 by a number of mounting bolts 21. A motor and thrust bearing mount 7 and motor 9 are mounted beneath top plate 5, i.e. within the interior of tubular casing 3, the functions of which will be described later. Motor control electronics are shown as circuit board 11 for illustrative purposes. Signal routing connections for the sensor 6 may also be conveniently placed on circuit board 11. Obviously, the components outside of tubular casing 3 and top plate 5 are exposed to the extreme environmental pressures at the ocean bottom as well as sand, debris, biological growth, and other adverse environmental factors. The inside of tubular casing 3, however, is kept dry and is kept at near atmospheric pressure. Appropriate seals are provided to environmentally separate the dry interior from the wet exterior.

In the recovery of a deployed underwater device 1, it is necessary to release the device from an anchor lying on the ocean floor. This is typically accomplished by sending an acoustic signal to the underwater device 1, detected by acoustic sensor 6 which generates a signal passing along electronic cabling to the circuit board electronics 11 within casing 3. This signal typically operates an electromechanical device which releases a movable member so as to, theoretically, pivot freely and release a connecting link connecting the device 1 with the anchor (not shown).

In FIG. 1, the movable member is in the form of a pelican hook 15 which has a pivot 19 on the frame 13. Hook 15 has an upper hook portion 27 and a lower projection 25 at its opposite ends. The hook portion 27 is movable into and out of blocking position with respect to a slot 12 in frame structure 13 by the moving of the projection 25 into or out of, respectively, vertical position with respect to an axis of the underwater device 1. The position with the hook portion 27 out of blocking relationship to slot 12, i.e. in the released condition, is shown in phantom by numeral 15' in FIG. 1. Projection 25 is both captured by and moved by a rotatable cam 23 which is driven by a shaft passing through top plate 5 and rotatable by an appropriate gearing arrangement (FIG. 16) driven by motor 9. Motor mount 7 not only provides a rigid mounting platform for the motor 9 and gearing arrangement, it also contains a thrust bearing for the rotatable cam 23 as will be described in connection with FIG. 16. Other components which are not visible in FIG. 1 will be described in connection with FIGS. 13–16 later in this description.

The use of a pivotable pelican hook 15 having a hook portion 27 for blocking and unblocking a slot 12 in a frame 13 is known in the art, as is a number of other latching mechanisms, other than a pelican hook, which has a movable member movable from one position to another to capture and release, respectively, a connecting or release link 17 connected to an anchor. Hereinafter, for ease of discussion, the connecting or release link 17 will be referred to as a connecting link.

Figure 2:
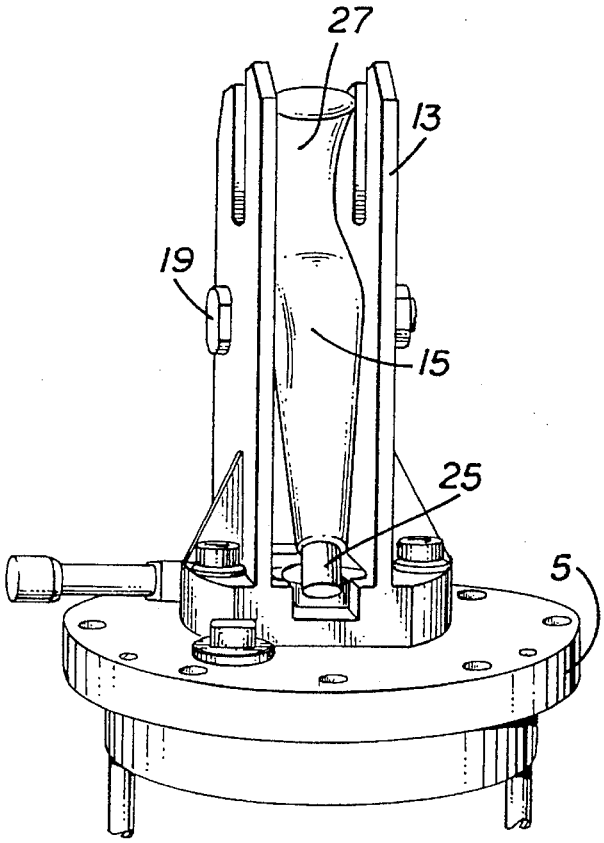
FIG. 2 is a partial right side elevational view of the invention shown in FIG. 1.

With this as background, it will be appreciated that simply releasing the lower end of pelican hook 15, i.e. setting it free to rotate about pivot 19, may or may not permit release of the connecting link 17 by hook portion 27, depending upon whether or not the upwardly directed force of the connecting link 17 against the lower surface of hook portion 27 will overcome the friction and contaminant blockage resistance all along the body of hook 15. If a sufficient amount of contamination has been wedged between the body of hook 15 and the sidewalls of frame structure 13 (see FIG. 2), or if some biological growth has appeared at the connection of the projection 25 with the mechanism which is holding projection 25 in its fixed or latched position, then the upwardly directed force applied by the floatation assembly (not shown) on connecting link 17 will be ineffective to cause pelican hook 15 to pivot, and the hook portion 27 cannot be pushed out of the way of the passage of link 17 through slot 12.

As seen in phantom in FIG. 1, however, a rotatable cam 23 is shown capturing projection 25 in a fixed, latched condition, and, as will be explained later, as rotatable cam 23 rotates, a positive driving action by the facial surface of cam 23 pushing projection 25 to the full unlatched position of hook 15 (shown at 15') will guarantee withdrawal of hook portion 27 from slot 12 and release of connecting link 17.

After pelican hook 15 is driven to its released position 15', only contamination or friction between connecting link 17 and the walls 14, 16 of slot 12 will inhibit release of link 17. As can be seen in FIG. 1, however, the hook portion 27 of pelican hook 15 occupies the space immediately above the lower portion of connecting link 17 in the latched condition. When hook 15 is moved to its unlatched position 15', the region previously occupied by the hook portion 27 is obviously completely free of any debris. Furthermore, the opening of slot 12 at the top of frame structure 13 is tapered outwardly so as to minimize the possibility of any contamination between link 17 and frame 13 from inhibiting a sliding movement of link 17 through slot 12 to be completely released from the frame structure 13. Finally, the wall-to-wall dimension of slot 12 is made sufficiently greater than the diameter of the connecting link 17 to eliminate any frictional drag as link 17 moves within slot 12 as it is released.

Figure 3:
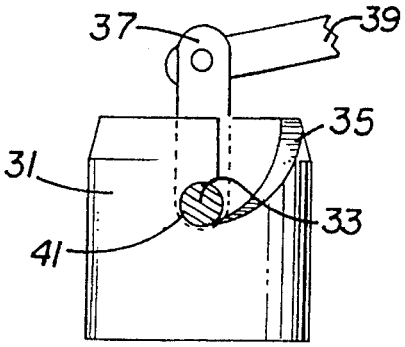
FIG. 3 PRIOR ART
FIGS. 3 and 4 illustrate a prior art actuator for moving a movable member into an unlatched position.
Figure 4:
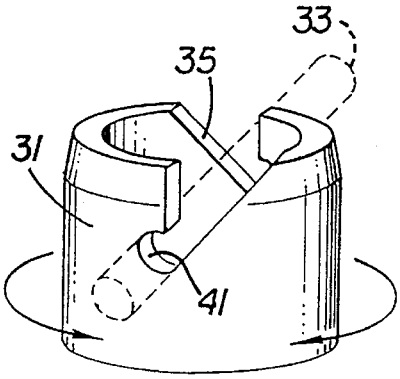
FIG. 4 PRIOR ART

FIGS. 3 and 4 depict a prior art arrangement for releasing a connecting link (not shown) using a camming action feature. In these figures, it will be observed that a pin 33 is captured within a capture slot 41 formed in opposite sides of a hollow cylindrical member 31. A ramp 35 is formed by a cutout leading from slot 41 to the upper edge of cylinder 31. In this manner, rotating cylinder 31 clockwise (as seen from the top) will cam pin 33 upwardly and, in turn, lift reciprocating rod 37 upwardly. The end of rod 37 may be connected in any known manner to move a latch member out of the way so as to release the end of a pelican hook, for example, thereby permitting the pelican hook to freely rotate. In the prior art shown in FIGS. 3 and 4, it is known that the total movement of pin 33 upwardly is approximately one-quarter inch. This is sufficient to release a latch and permit a pelican hook to pivot, but it must be appreciated that the camming action of the ramp 35 against pin 33 as cylinder 31 rotates is simply to effect the release of the bottom of pelican hook 15 and not to move it positively as is the case with the present invention. Accordingly, while this type of prior art device is known and has been used with undersea acoustic transponder devices, there was no suggestion to use the camming action as a positive driving force to move the movable member (e.g. pelican hook 15). Consequently, the movable member can become jammed due to friction and contamination the same as the other prior art devices.

Figure 5:
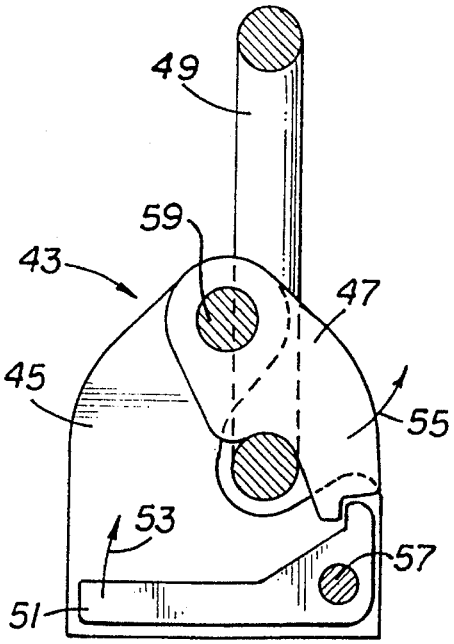
FIG. 5 PRIOR ART
FIG. 5 illustrates another prior art connecting link release mechanism.

FIG. 5 is offered to show another prior art release mechanism. In FIG. 5, a frame 45 is mounted to the top of a transponder (not shown), and a latch bar 47 is mounted to frame 45 by a pivot 59. Latch bar 47 captures the lower end of connecting link 49 by forming an opening between latch bar 47 and frame 45 as shown. A latch release finger 51 is movable in the direction of arrow 53 about pivot 57 to release latch bar 47 to move in the direction of arrow 55. As with other prior art arrangements, however, in the severe environment with which these types of devices are employed, simply moving latch release finger 51 upwardly, while it may permit latch bar 47 to rotate about pivot 59, does not guarantee that contamination will not have worked against the movement of latch bar 47 to more than offset the upward pulling force of link 49 against latch bar 47. Again, serious reliability factors are associated with this type of device, as with the other prior art devices discussed above.

Figure 6:
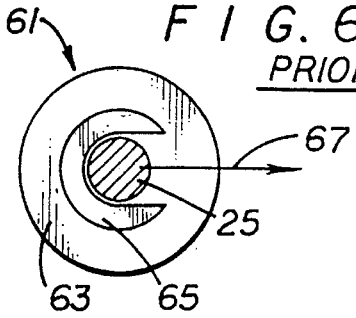
FIG. 6 PRIOR ART
FIGS. 6 and 7 illustrate two positions of another prior art release mechanism.
Figure 7:
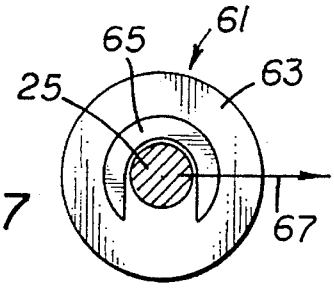
FIG. 7 PRIOR ART

A further type of prior art release mechanism worthy of discussion is shown in FIGS. 6 and 7. Here, a rotatable release apparatus 61 includes a rotatable plate 63 which has a C-shaped pocket 65 either mounted thereon or formed integrally therewith by a milling operation. In the orientation of the pocket 65 in FIG. 6, the hook projection 25 (cf FIG. 1) is free to move to the right as shown by arrow 67. In FIG. 7, the rotatable plate and pocket 65 have been rotated 90° clockwise so as to block the path of hook projection 25 in the direction of arrow 67 by the side walls of the pocket 65. While this prior art arrangement makes use of a rotatable release apparatus 61, its only purpose is to selectively release hook projection 25 of a pelican hook so as to permit it to pivot and release a connecting link, provided that hydrostatic pressure and contamination factors permit it. Thus, while disclosing a rotatable release apparatus, no positively driven releasing function is suggested by this arrangement, and it suffers from the same deficiencies of other prior art devices.

Figure 8:
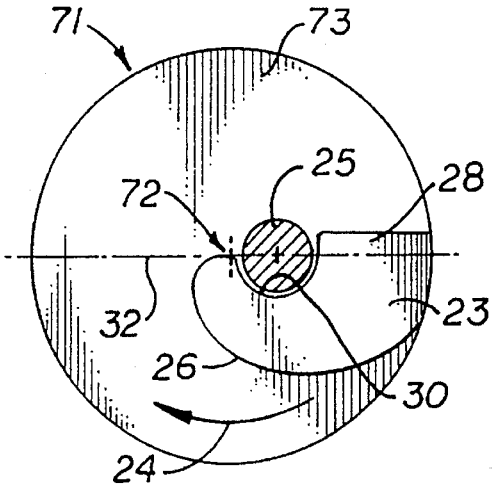
FIGS. 8–12 show the positive camming action of the preferred embodiment according to the present invention, with FIG. 8 showing the captured position of a movable releasing member.

FIGS. 8–12 are top views of the rotatable cam 23, according to the present invention, as would be viewed from the top in FIG. 1. In a preferred embodiment of the invention, rotatable cam 23 is mounted on or is integral with a rotatable plate 73, the two components together defining a rotatable release mechanism 71 shown in FIGS. 8–12. As can be observed in FIG. 8, the center of rotatable plate 73 is slightly to the left of hook projection 25 of the pelican hook 15. From FIGS. 1 and 8, it will be appreciated that the outer cam face 26 of cam 23 is a vertical wall, and in the preferred embodiment follows a nonlinear path from the center 72 of plate 73 to the outer periphery of plate 73 where it forms butt end 28. It will also be noted that butt end 28 extends beyond 180° from the starting point of the spiral cam face 26 so as to block hook projection 25 from moving to the right in FIG. 8. FIG. 8 thus shows the fully latched position of pelican hook 15 where projection 25 is fully captured in pocket 30 which is circular in shape with a radius slightly larger than that of the radius of hook projection 25. With the center of hook projection 25 aligned with the center 72 of plate 73 and fully contained within pocket 30, hook projection 25 has a swing path in vertical plane 32 perpendicular to the horizontal plane of rotatable plate 73. As a result, unless butt end 28 is moved completely out of the swing path of hook projection 25, the underwater device remains securely fastened to the anchor by connecting link 17.

Figure 9:
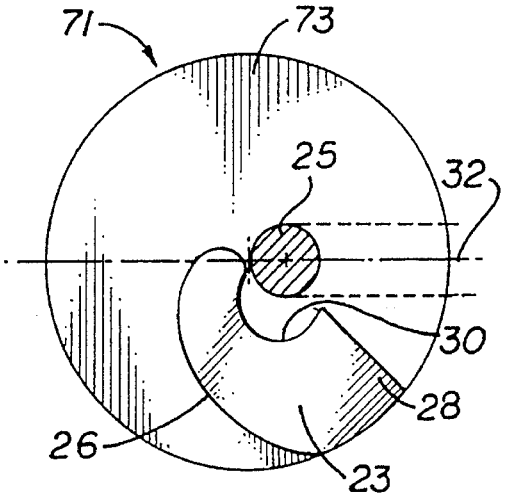

FIG. 9 shows that rotatable plate 73 and, likewise, rotatable cam 23 have moved approximately 45° in a clockwise direction (as viewed from the top of FIG. 1). At this angular position, because of the geometrically increasing radius of the cam face 26, a 45° movement as shown in FIG. 9 is effective to only move projection 25 slightly to the right along the swing path plane 32.

Figure 10:
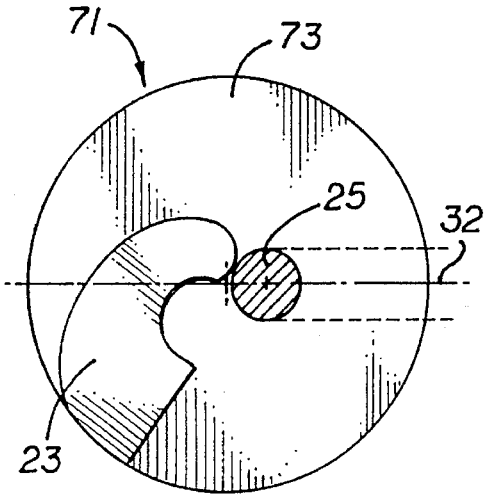

In FIG. 10, cam 23 is shown to be rotated clockwise approximately 120° from its starting point. Still, the extent of movement of projection 25 along its swing path 32 is relatively small.

Figure 11:
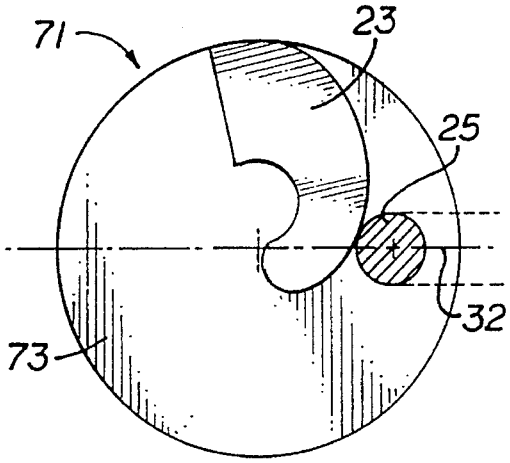
Figure 12:
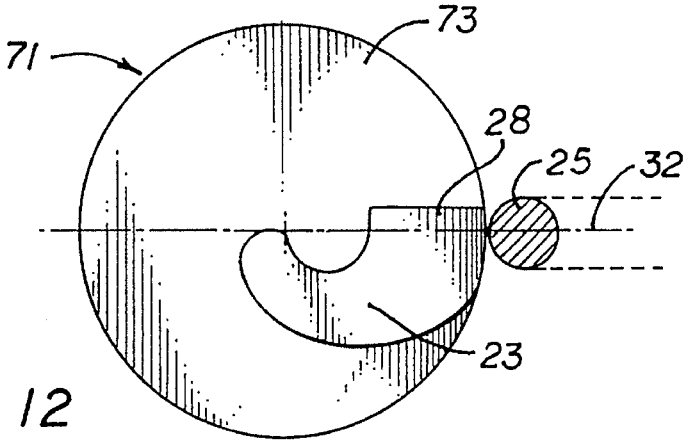

When cam 23 is rotated clockwise to approximately 270°, as shown in FIG. 11, projection 25 has been cammed to approximately one half of the radius of plate 73, and finally after a full 360 degrees of rotation of cam 23, projection 25 is cammed to its maximum radial position. At this position of projection 25, however, the hook portion 27 of pelican hook 15 will be well out of blocking position of slot 12 (see FIG. 1), and the operation of rotatable cam 23 has performed the desired function of positively driving the pelican hook to its fully released position.

The geometry of the cam face 26 is important from the viewpoint that, as explained many times before, the pelican hook 15 may be jammed or have a high resistance to movement because of contamination, or may otherwise be extremely difficult to move from its fully latched position to its fully unlatched position. It will be appreciated by those skilled in the art, however, that the highest amount of friction and resistance to movement of the pelican hook 15 occurs at the beginning of its movement away from its latched position. Accordingly, by providing cam 23 with a nonlinear, spiral-shaped, cam face 26, the torque applied to rotatable plate 73 will transform to a large moving force at the beginning of the release cycle and gradually reduce as projection 25 moves further radially of plate 73. This design advantageously applies maximum moving force to projection 25 when it is needed most. After breaking any frictional or jammed condition by the initial movement of projection 25, continued movement along swing path plane 32 requires less energy. Thus, relatively speaking, a smaller driving force of the motor 9 is required using the nonlinear cam face 26 than would be required if cam face 26 were linear.

Figure 13:
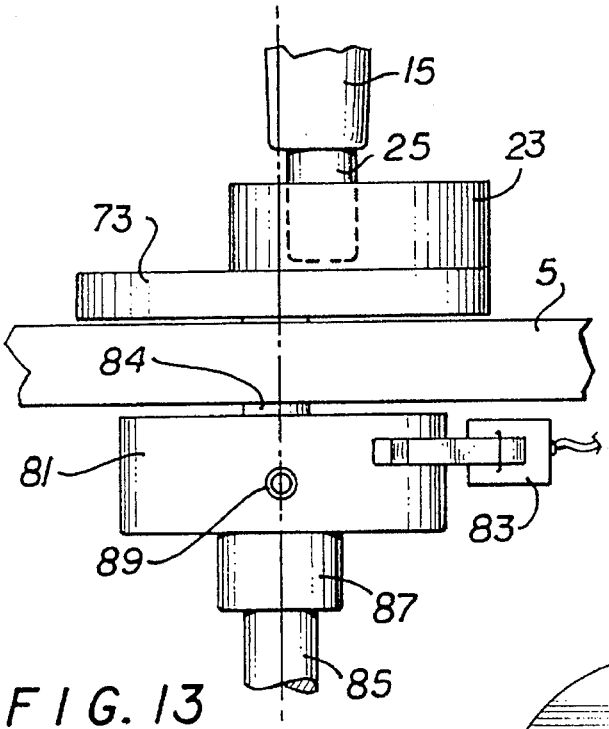
FIG. 13 is a side elevation view of the major functional components making up the preferred embodiment of the present invention, including a rotatable cam and indexing wheel arrangement.

FIG. 13 is a partial side view of the bottom of the pelican hook 15, the rotatable cam 23, top plate 5, and an indexing wheel or drum 81 mounted on a shaft 84 which is integral with or firmly fixed to rotatable cam 23. Indexing wheel 81 has an integral collar 87 within which a drive shaft from appropriate gearing (FIG. 16) may be securely fitted. In any event, when the motor 9 (FIG. 1) rotates, gearing output shaft 85, index wheel 81, shaft 84, rotatable plate 73, and rotatable cam 23 all rotate together. Indexing wheel 81 is also associated with a thrust bearing arrangement which will be described later.

Figure 14:
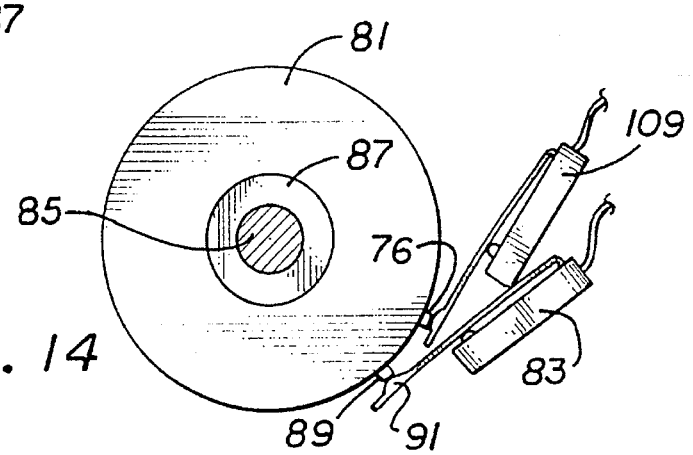
FIG. 14 is a bottom view of the indexing wheel which is effective to operate an electrical switch at the appropriate angular rotation of the positively driven camming element according to the present invention.

FIG. 14 is a bottom view of part of the arrangement shown in FIG. 13. On the periphery of indexing wheel 81 is an indexing element 89, shown in FIG. 14 as a pin projection.

It will be appreciated that, depending upon the type of switch operated by the indexing element 89, a groove in the periphery of indexing wheel 81 could be suitably effective. In the preferred embodiment, however, a microswitch 83 is provided with a microswitch arm 91 which, in turn, is cause to activate the microswitch 83 when the arm 91 comes into contact with indexing element 89. The purpose of indexing element 89 is to insure that rotatable plate 73 and its attached rotatable cam 23 will be properly positioned in a latched condition at the beginning of the camming cycle. Microswitch 83 therefore interrupts the power to motor 9 when indexing element actuates microswitch 83, and the circumferential position of indexing element 89 is chosen so that microswitch 83 is activated when cam 23 is in the FIG. 8 position.

Figure 15:
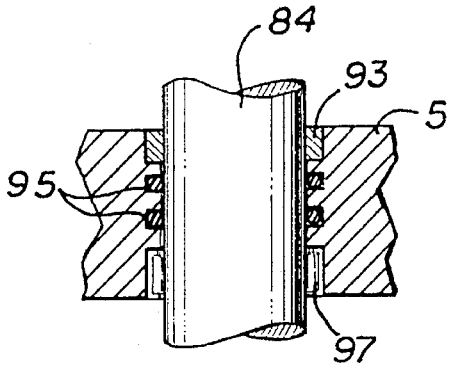
FIG. 15 is a partial cross-sectional area of the region of passage of the shaft for the rotating cam and indexing wheel, as the shaft passes through the end plate of the underwater device.

FIG. 15 is a side cross-sectional view of the area in top plate 5 through which shaft 84 passes. In a typical bearing of this type, a composite bushing 93 is provided at the top to reduce frictional forces as the cam shaft 84 rotates, and, in addition, to keep debris from entering the region between the shaft 84 and top plate 5. Then, a set of dual O-ring seals is provided to prevent water from entering the interior of tubular casing 3, and finally a needle bearing 97 is provided on the dry side of the shaft 84 for smooth journalling of the shaft 84 relative to top plate 5.

As was alluded to earlier in this description, the unbalanced pressure differential between the outside hydrostatic pressure and the internal pressure of the sealed transponder device 1 is extremely high, and in the preferred embodiment of the invention using a rotatable cam as shown in FIG. 13, this pressure difference would tend to drive cam 23 into the upper surface of top plate 5 creating a prohibitively high frictional drag between these two components. The same problem exists with the prior art arrangement shown in FIGS. 6 and 7, and in the past this problem has been approached by providing a washer of low coefficient of friction between the rotatable plate 63 and the top plate 5 of the transponder. With the present invention, a different, vastly superior, approach is offered.

Figure 16:
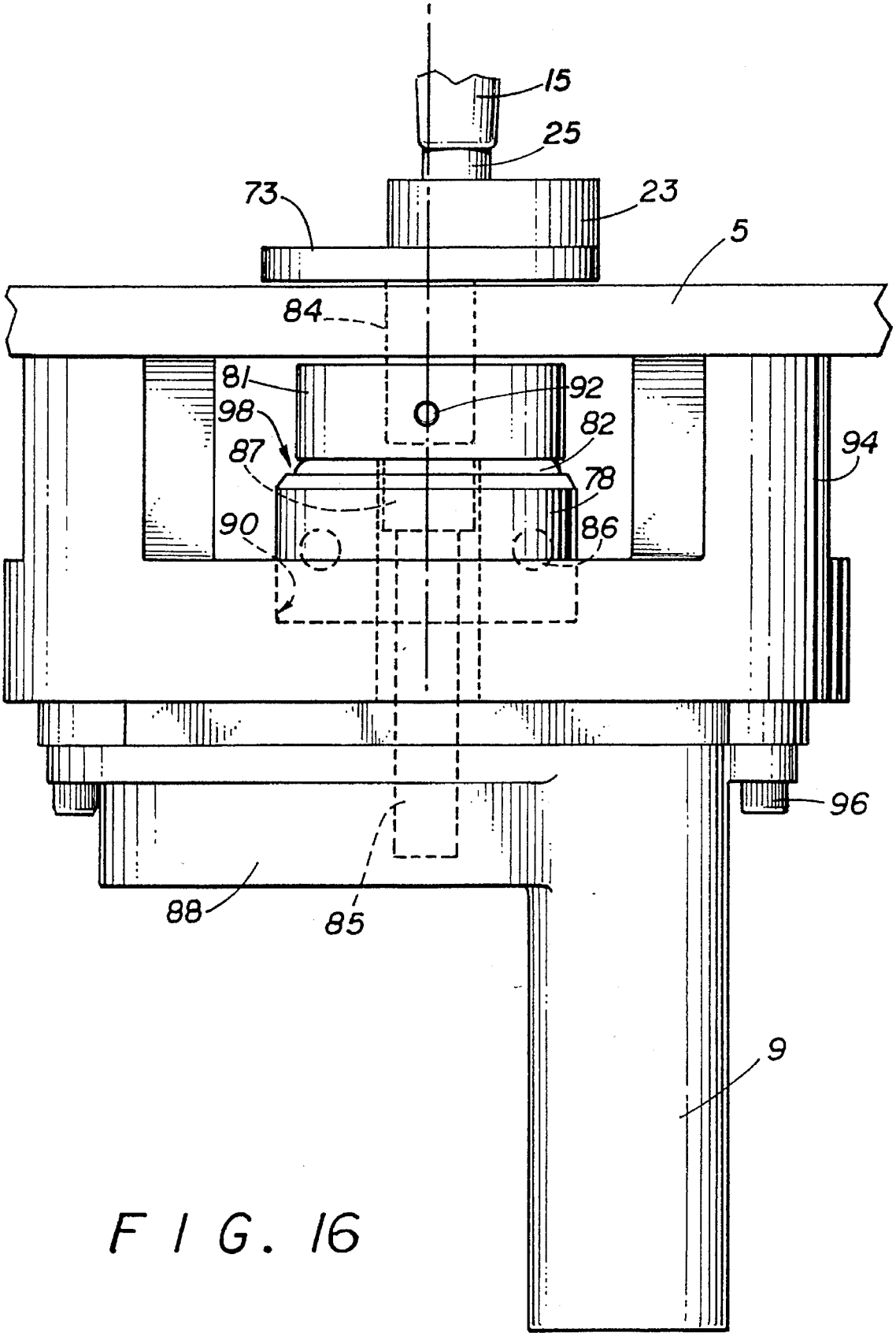
FIG. 16 illustrates a preferred embodiment of an internal thrust bearing arrangement.

With reference to FIG. 16, the shaft 84, integral with or rigidly attached to rotatable plate 73 and cam 23, projects through top plate 5 and well into the center of indexing wheel 81. A steel pin 92 is driven into axially aligned bores in shaft 84 and wheel 81 so as to rigidly fix wheel 81 to be immovable on shaft 84. As a result, any external pressure applied against plate 73 and cam 23 also applies a pressure through shaft 84 downwardly on indexing wheel 81.

A heavy duty support block 94 is attached to the underside of top plate 5 by means of bolts 96 passing through gear housing 88 and threaded into top plate 5. Support block 94 has a recess 90 to accommodate the lower bearing race 78 of a thrust bearing 98 in an interference fit, thereby holding lower bearing race 78 fixed relative to support block 94. The upper bearing race 82 is rotatable relative to lower race 84 by the provision of a plurality of bearing balls 86. The lower face of wheel 81 rests upon the upper face of upper bearing race 82. Consequently, thrust bearing 98 provides a smooth bearing function for the rotatable cam 23 and avoids the typical high frictional drag associated with prior art construction. As pointed out earlier, the friction coefficient of the internal thrust bearing 98 can be as low as 0.001 as compared with a typical external bearing coefficient of 0.08. The material, size, and construction of support block 94, and the design of thrust bearing 98, are chosen to accommodate extremely high axially directed forces on the order of 4800 lbs.

Figure 17:
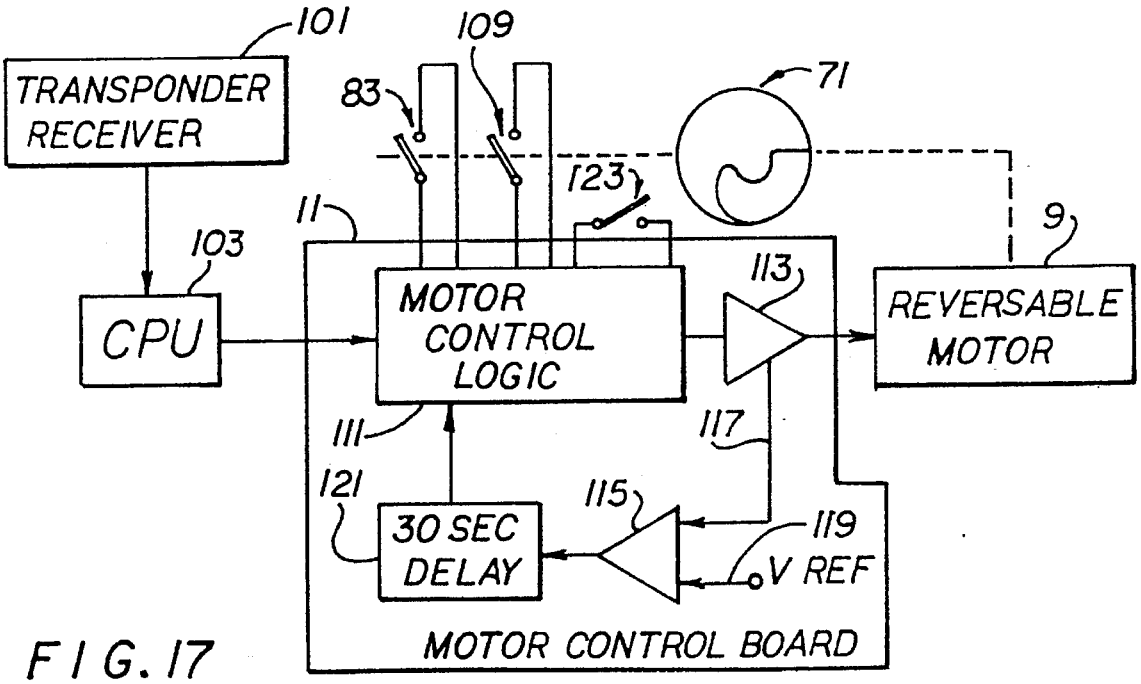
FIG. 17 is a block diagram of the major functional blocks of the motor control system.

FIG. 17 is a functional block diagram of a preferred motor control system according to the present invention. The specific arrangement shown in FIG. 17 assumes that the underwater device is a transponder, and that a central processor unit, CPU 103, is involved in the controlling of the reversible motor 9. However, the controlling of the motor 9 by the CPU 103 is purely optional and is the preferred choice of convenience in operating the motor 9. Other implementations of the invention can be readily provided by one skilled in the art. For example, a series of relays could replace CPU 103.

In the preferred embodiment shown in FIG. 17, it is assumed that the cam 71 is at its initial latched position. A command signal is sent to the underwater device and sensed by the transponder receiver 101 which relays the information to CPU 103. CPU 103 sends a signal to motor control logic 111, on motor control board 11, which provides an output drive signal to motor driver 113 connected to the reversible motor 9.

Assuming that a "release" signal is sent to transponder receiver 101, motor 9 begins to rotate cam 71 in the clockwise direction. Without any obstruction to the rotation of cam 71, it eventually will rotate until an indexing element 76 (see FIG. 14) closes switch 109. Switch 109 is a limit switch, and indexing element 76 is spaced approximately 8° counterclockwise from the position of indexing element 89 on the periphery of indexing wheel 81. Thus, after cam 71, and indexing wheel 81, rotate a total of 352°, switch 109 will close, instructing motor control logic 111 to remove the driving voltage to motor 9. At this point, the unlatching function is concluded, the underwater device will have been freed from the anchor link, and the release procedure is thus completed.

After the underwater device has been retrieved, it can easily be reattached to an anchor link for re-deployment simply by closing a manual "motor reverse" switch 123 or by simply, and preferably, sending a signal to transponder receiver 101 instructing CPU 103 to apply a "motor reverse" signal to motor control logic 111 which then will cause motor driver 113 to apply power to motor 9 in a reverse its direction. A small force, for example manually applied to the pelican hook in the latching direction, will allow the projection 25 of the pelican hook to follow backwards the facial cam surface of cam 71 until cam 71 is brought to its fully latched position. At this point, as mentioned earlier, microswitch 83 will be activated due to the contact of macro switch arm 91 with indexing element 89. When switch 83 is activated, cam 71 is indexed to its fully latched condition. It will be recalled, however, that when an instruction to motor control logic 111 is to rotate motor 9 clockwise (in the unlatching direction), cam 71 will move clockwise and immediately switch 83 will deactivate, e.g. close. In this way, the instructing signal from the CPU 103 can be removed, and motor 9 will continue to move in the clockwise direction due to the closure of switch 83. Switch 83 will not open again due to clockwise rotation of motor 9, since, 8° prior to cam 71 reaching a position which would open switch 83, limit switch 109 will have been activated to remove power to motor 9.

In the event of a binding of parts of the unlatching mechanism (e.g. cam 71 and/or pelican hook 15 becoming jammed), any attempt to rotate motor 9 in the clockwise direction for the movement of cam 71 can result in failure. When motor 9 is not able to be driven by motor driver 113 when a jam occurs, an excessive current is developed at the output of driver 113, as will be understood by those skilled in the art, and a voltage proportional to that excessive current is applied on line 117 to one input of a differential amplifier 115. The other input on line 119 of differential amplifier 115 is connected to a reference voltage. Thus, when motor 9 is jammed, the voltage on line 117 exceeds the reference voltage on line 119, and an output from differential amplifier 115 is applied to 30 second delay circuit 121 which, in turn, sends a signal delayed by 30 seconds (or any other desired value) to logic circuit 111 as instructions to reverse the action of motor 9.

Motor 9 will reverse its direction until cam 71 is moved back to its initial position at which point switch 83 is again activated to remove power from motor 9. However, since switch 109 has not yet been activated, the system recognizes that the cam has not rotated to its fully released position, and therefore motor 9 will again be powered to rotate clockwise in an attempt to turn cam 71 clockwise in the releasing mode. Again, if cam 71 is not able to rotate beyond a certain point before it becomes jammed again, excessive current developed at the output of driver 113 attempting to drive motor 9 will again send a signal through differential amplifier 115 and delay circuit 121 to reverse the motor 9. This process continues until the contamination and/or friction has been overcome by the repeated driving and reversing of the cam 71. Delay circuit 121 is inserted in the circuit to permit the driving power from driver 113 to attempt to rotate motor 9 for a prescribed time period of, for example, 30 seconds. After 30 seconds of delay, if switch 109 has not yet been activated, the reverse mode for motor 9 is effectuated. Accordingly, each attempt to drive cam 71 clockwise lasts for 30 seconds, and in the event of failure, the motor is reversed back to its starting position, and a subsequent 30 second drive period is begun. The process continues until a successful release is made, or the process may be terminated by a "halt" input command signal to the transponder receiver 101, and attempts to make the release may be made at a later time.

It will be understood that the above-described reversing process for motor 9 is an extreme safety precaution measure, since it is not anticipated that conditions will be such as to prevent successful release by normal camming action. However, this added benefit of a positively driven release mechanism is at least possible with the present invention and has heretofore been unavailable with prior art devices.

It will be readily apparent that the various components and/or procedural steps in the operation of the present invention can be modified from the specific embodiment shown and described herein. Accordingly, the invention is not to be limited by the preferred embodiments described, but rather by the appended claims.

I claim:

1. An undersea release apparatus for positively releasing a connecting link from an underwater device, said apparatus comprising:

latching means on said device for latching the connecting link to the device, defining a latched condition, and for unlatching the connecting link to be free of the device, defining an unlatched condition, said latching means comprising a first movable member, movable to a first position in which said latching means latches said connecting link in said latched condition, and to a second position in which said latching means unlatches said connecting link in said unlatched condition; and driving means coupled to said latching means for positively driving said latching means to its unlatched condition, said driving means comprising a second movable member for blocking movement of said first movable member and retaining said first movable member fixed at said first position, and for unblocking movement of said first movable member and positively driving said first movable member from said first position to said second position.

2. An undersea release apparatus for positively releasing a connecting link from an underwater device, said apparatus comprising:

latching means on said device for latching the connecting link to the device, defining a latched condition, and for unlatching the connecting link to be free of the device, defining an unlatched condition; and driving means coupled to said latching means, said driving means comprising a movable cam for positively camming said latching means to its unlatched condition.

3. The apparatus as claimed in claim 1, wherein:

said latching means comprises a movable member, movable to a first position in which said latching means latches said connecting link in said latched condition, and to a second position in which said latching means unlatches said connecting link in said unlatched condition; and said movable cam comprises means for retaining said movable member fixed at said first position, and means for camming said movable member from said first position to said second position.

4. The apparatus as claimed in claim 3, wherein:

said movable cam has a rotatable cam face engageable with said movable member; and said driving means further comprises a motor and gearing for rotating said cam, whereby the rotation of said cam face against said movable member drives said movable member from said first position to said second position.

5. The apparatus as claimed in claim 4, wherein:

said cam is rotatable between first and second angular positions, whereby when said cam is in said first angular position, said latching means is in said latched condition; and said cam is rotatable away from said first angular position to move said movable member toward its unlatched position at which said latching means is in said second condition.

6. The apparatus as claimed in claim 4, wherein:

said latching means comprises a slotted bracket mounted on said underwater device, said bracket having a slot defined by a pair of sidewalls and an end wall; and said movable member comprises a pivotable hook having a hook portion movable to block and unblock passage of said connecting link into and out of said slot, said connecting link being captured between said hook portion, said sidewalls, and the end wall of said slot when said latching means is in said latched condition, and said connecting link is free to slide into and out of said slot when said latching means is in said unlatched condition.

7. The apparatus as claimed in claim 6, wherein:

said pivotable hook is an elongated hook with said hook portion at one end, a projection engageable by said cam at the other end, and means for pivoting, intermediate said ends, said pivotable hook relative to said slotted bracket.

8. The apparatus as claimed in claim 4, wherein:

said rotating cam is driven by said motor and gearing at a substantially constant angular rate; and said cam face has a surface configured geometrically to present a nonlinear camming pressure to said movable member, said camming pressure being greatest at the beginning of movement of said movable member away from said first position.

9. The apparatus as claimed in claim 4, wherein:

said rotating cam is rotatable in both forward and reverse angular directions;

in said forward angular direction, said rotatable cam is effective to move said movable member from said first position to said second position; and in said reverse angular direction, said rotatable cam permits said movable member to move back to its first position in which said latching means latches said connecting link.

10. The apparatus as claimed in claim 4, wherein said underwater device has a top plate, and said driving means comprises:

a shaft, having top and bottom ends, passing through said top plate, said rotating cam fixed to said shaft top end above said top plate;

a wheel fixed to said shaft bottom end below said top plate, said wheel comprising an indexing element on its periphery; and switch means mounted adjacent said wheel and operable by engagement with said indexing element to remove power applied to said motor when said cam, and therefore said wheel, are rotated to a position to retain said movable member fixed at said first position.

11. The apparatus as claimed in claim 7, wherein:

said rotatable cam has a central axis about which it rotates, and has a pocket offset radially from said central axis; and said projection of said elongated hook is captured in said pocket when said cam retains said movable member fixed at said first position.

12. The apparatus as claimed in claim 7, wherein said elongated hook is a pelican-type hook.

13. The apparatus as claimed in claim 8, wherein said cam face surface is a vertical wall following a spiral path beginning at the axis of rotation of said rotatable cam and ending at a radial distance from said axis of rotation sufficient to cam said movable member to said second position.

14. The apparatus as claimed in claim 4, wherein said underwater device has a top plate, and said driving means comprises:

a shaft, having top and bottom ends, passing through said top plate, said rotating cam fixed to said shaft top end above said top plate; and a thrust bearing arrangement mounted beneath said top plate and providing thrust bearing support for said bottom end of said shaft.

15. The apparatus as claimed in claim 14, comprising a wheel fixed to said shaft bottom end below said top plate, said wheel having a bottom surface, and wherein said thrust bearing arrangement comprises:

a support block mounted to the underside of said top plate; and a thrust bearing having a rotatable upper race in contact with said wheel bottom surface, and a lower race fixed to said support block.

16. An undersea release apparatus for releasing a connecting link from an underwater device subjected to high levels of hydrostatic pressures, said apparatus comprising:

a container for said underwater device having containing walls;

latching means on said container for latching the connecting link to the device, defining a latched condition, and for unlatching the connecting link to be free of the device, defining an unlatched condition;

driving means coupled to said latching means for setting said latching means to its unlatched condition, said driving means comprising a rotatable shaft, having top and bottom ends, journalled in and passing through a wall of said container, said shaft coupled at its top end to, and actuating, said latching means; and a thrust bearing arrangement mounted internally of said container and beneath said wall and providing thrust bearing support for said bottom end of said shaft for reducing the axial friction on said shaft under high levels of hydrostatic pressures in deep water environments.

17. The apparatus as claimed in claim 16, comprising a wheel fixed to said shaft beneath said wall, said wheel having a bottom surface, and wherein said thrust bearing arrangement comprises:

a support block mounted to the underside of said wall; and a thrust bearing having a rotatable upper race in contact with said wheel bottom surface, and a lower race fixed to said support block.

18. An undersea release apparatus for positively releasing a connecting link from an underwater device, said apparatus comprising:

latching means on said device for latching the connecting link to the device, defining a latched condition, and for unlatching the connecting link to be free of the device, defining an unlatched condition;

driving means coupled to said latching means for positively urging said latching means to its unlatched condition;

detecting means for detecting if said latching means has been positively driven to its unlatched condition;

reversing means responsive to said detecting means detecting that said latching means has not been driven to its unlatched condition for reversely driving said driving means to urge said latching means back toward its latched condition; and means for cyclically urging said latching means toward its unlatched and latched conditions.

19. The apparatus as claimed in claim 18, comprising means to delay reversely driving said driving means for a predetermined length of time.

20. The apparatus as claimed in claim 18, comprising disabling means for disabling said driving means and said reversing means.

21. The apparatus as claimed in claim 20, wherein said disabling means disables said driving means and said reversing means responsive to said detecting means detecting that said latching means has been driven to its unlatched condition.

* * * * *